US008899712B2

(12) United States Patent
Vall et al.

(10) Patent No.: US 8,899,712 B2
(45) Date of Patent: Dec. 2, 2014

(54) PRINTING SYSTEMS AND METHODS PERFORMED BY PRINTING SYSTEMS

(75) Inventors: Marc Serra Vall, Barcelona (ES); Maria Elizabeth Zapata, Barcelona (ES); Eduardo Amela Conesa, Granyena de Segarra Lleida (ES); Jacint Humet Pous, Santa Perpetua de Mogoda Barcelona (ES); Jaime Fernández del Rio, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 439 days.

(21) Appl. No.: 13/222,498

(22) Filed: Aug. 31, 2011

(65) Prior Publication Data

US 2013/0050322 A1 Feb. 28, 2013

(51) Int. Cl.

| | |
|---|---|
| ***B41J 29/38*** | (2006.01) |
| ***B41J 29/393*** | (2006.01) |
| ***B41J 2/21*** | (2006.01) |
| ***B41J 2/175*** | (2006.01) |

(52) U.S. Cl.

CPC ..... *B41J 2/175* (2013.01); *B41J 29/393* (2013.01); *B41J 2/2114* (2013.01)

USPC ..... 347/14

(58) Field of Classification Search

CPC ..... B41J 2/175; B41J 29/393; B41J 2/2114

USPC ..... 347/14, 19, 101; 372/38.02

See application file for complete search history.

(56) References Cited

U.S. PATENT DOCUMENTS

| | | | | |
|---|---|---|---|---|
| 5,898,443 | A * | 4/1999 | Yoshino et al. | 347/19 |
| 5,980,016 | A | 11/1999 | Nelson et al. | |
| 6,494,557 | B1 * | 12/2002 | Kato et al. | 347/19 |
| 6,834,947 | B2 | 12/2004 | Moriyama et al. | |
| 7,196,714 | B2 | 3/2007 | Someno | |
| 7,357,472 | B2 | 4/2008 | Yamanobe | |
| 2004/0104987 | A1 * | 6/2004 | Smith et al. | 347/101 |
| 2005/0057598 | A1 * | 3/2005 | Endo et al. | 347/19 |
| 2006/0023761 | A1 * | 2/2006 | Moriyama | 372/38.02 |
| 2009/0289985 | A1 * | 11/2009 | Sumida et al. | 347/19 |
| 2010/0238509 | A1 | 9/2010 | Ogawa | |
| 2010/0302588 | A1 | 12/2010 | Ohno | |
| 2013/0021398 | A1 * | 1/2013 | Mizes et al. | 347/14 |

FOREIGN PATENT DOCUMENTS

| | | | |
|---|---|---|---|
| JP | 2000-0127375 | A | 5/2000 |
| JP | 2001-138494 | A | 5/2001 |

* cited by examiner

*Primary Examiner* — Alessandro Amari
*Assistant Examiner* — Carlos A Martinez

(57) ABSTRACT

A method performed by a printing system is described herein. A request is provided to a user to enter data related to print quality of a mark or marks printed on a portion of a background region. The background region includes an area or areas treated with a fixer fluid applied by a printhead. A user input is received associated to the request. A misalignment of the printhead is estimated in accordance with the user input. A printing system and a tangible machine readable storage medium are also described herein.

19 Claims, 5 Drawing Sheets

PRINTING SYSTEMS AND METHODS PERFORMED BY PRINTING SYSTEMS

BACKGROUND

Some printing systems form a printed image by ejecting ink from ink printheads. Thereby, ink is applied onto the print medium for printing a pattern of individual dots at particular locations of an array defined for the printing medium. The printed pattern reproduces an image on the printing medium. At least some of these printing systems are commonly referred to as inkjet printers.

A fixer fluid may be used for improving print quality of a printed pattern. In particular, a fixer fluid may address coalescence, bleed, or similar effects characterized by ink or pigment migration across a printed surface. A printing system may include a treatment printhead configured to eject a fixer fluid. The treatment printhead applies the fixer fluid by ejecting the fixer over the particular locations for ink placement. Thereby, the fixer treats ink on the print medium in order to prevent coalescence, bleed, or similar effects. The fixer fluid may be applied before, after or, quasi-simultaneously to the application of the ink.

Accurate application of the fixer fluid on the particular locations for ink placement improves print quality since, otherwise, ink on the print medium may remain untreated. Misalignment of a treatment printhead may compromise an accurate application of the fixer fluid. Therefore, methods and systems for estimating whether a treatment printhead is misaligned are desirable. Further, a misalignment estimation may be used for quantifying the misalignment of the treatment printhead and, eventually, correcting misalignment of a treatment printhead in subsequent printing.

BRIEF DESCRIPTION OF THE DRAWINGS

The Figures depict embodiments, implementations, and configurations of the invention, and not the invention itself.

DETAILED DESCRIPTION

In the foregoing description, numerous details are set forth to provide an understanding of the examples disclosed herein. However, it will be understood by those skilled in the art that the examples may be practiced without these details. Further, in the following detailed description, reference is made to the accompanying drawings which form a part hereof, and in which various examples are shown by way of illustration. In this regard, directional terminology, such as "top," "bottom," "front," "back," "leading," "trailing," "left," "right," etc., is used with reference to the orientation of the Figure(s) being described. Because disclosed components can be positioned in a number of different orientations, the directional terminology is used for purposes of illustration and is in no way limiting.

Figure 1:
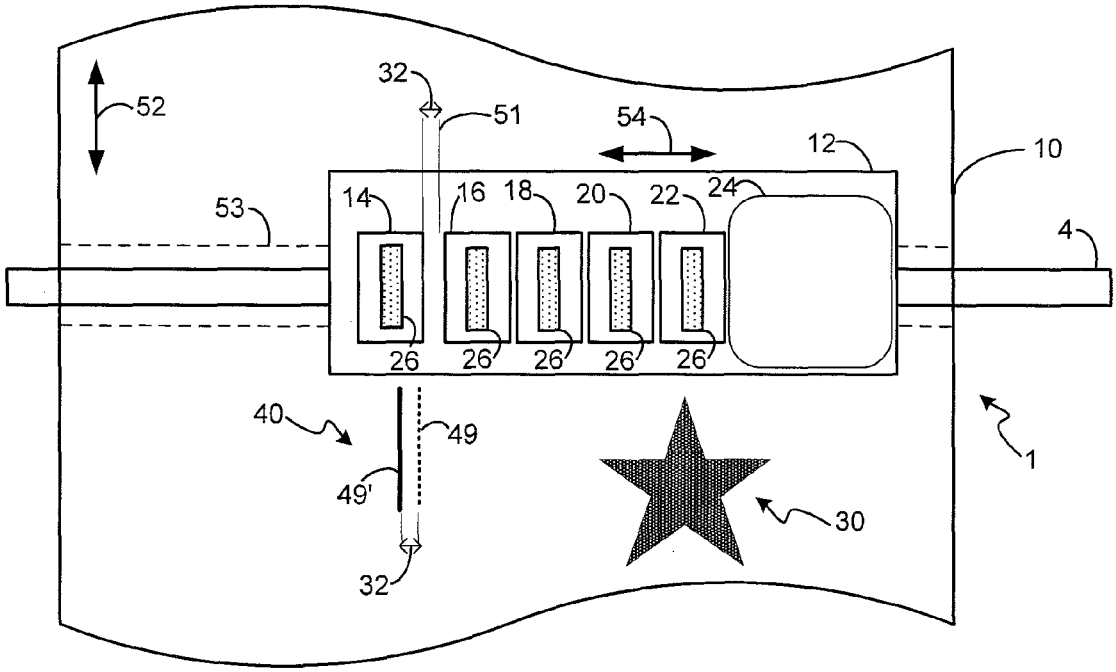
FIG. 1 is a schematic diagram of a portion of a printing system according to an embodiment.

The diagram of FIG. 1 shows a portion of a printing system 1 according to an example. Printing system 1 is for reproducing an image 30 on a print medium 10. Typically, printing system 1 is an inkjet printer. Printing system 1 includes a movable carriage 12 mounted on a carriage rod 4. In the example, carriage 12 supports four ink printheads 16, 18, 20, 22 (which constitute an ink printhead assembly), a treatment printhead 14, and an optical sensor 24 for estimating misalignment of an ink printhead.

As used herein, a printhead is a device including a nozzle or an array of nozzles 26 through which drops of a fluid (e.g., an ink or a fixer) can be ejected. The particular fluid ejection mechanism within the printhead may take on a variety of different forms such as, but not limited to, those using piezoelectric or thermal printhead technology.

Each of ink printheads 16, 18, 20, 22 is configured to eject ink of a different color (referred to as base colors.) Commonly used ink colors include cyan, magenta, yellow, and black. Printing systems commonly employ a plurality of ink printheads to produce secondary colors by combining ink from different ink printheads. Base colors are reproduced on print medium 10 by depositing a drop of the required color onto a dot location. Secondary or shaded colors are reproduced by depositing drops of different base colors on adjacent dot locations. The human eye interprets the color mixing as the secondary color or shading.

A treatment printhead as used herein is a printhead configured to eject fixer fluid for treating an area of a print medium through a nozzle or an array of nozzles (such as nozzles 26). As used herein, a fixer fluid is a fluid for reducing mobility of ink on a print medium. Fixer fluids are typically materials that may be applied beneath a colored ink drop (pre-coats or undercoats) and/or materials that may be applied over a colored ink drop (post-coats or overcoats.) Further examples of fixer fluids are detailed below.

It will be appreciated that embodiments can be realized with any number of printheads suitable for a particular application of printing system 1. For example, printing system 1 may include at least one treatment printhead, such as two or more treatment printheads. Furthermore, printing system 1 may include at least one ink printhead, such as two to six ink printheads, or even more ink printheads. Further, a printhead of printing system 1 may be a disposable printhead or a fixed printhead designed to last for the whole operating life of printing system 1.

Printing system 1 is capable of engendering a relative movement between the printheads mounted on carriage 12 and print medium 10. In the illustrated example, carriage 12 is capable of traversing over a printing surface of print medium 10 in a carriage translation axis 54. Further, printing system 1 includes a print media transport assembly 28 (shown in FIG. 3) on which print medium 10 is supported and advanced in a media translation axis 52. It will be appreciated that embodiments can be realized in which printing system 1 engenders relative displacement between the printing printheads and the print medium in different manners such as, but not limited to, scanning of carriage 12 over an area of print medium 10 extending along the vertical and horizontal axes.

In operation, printing system 1 prints an image 30 on print medium 10 by traversing carriage 12 over the surface of print medium 10 while nozzle arrays 26 of ink printheads 16, 18, 20, 22 and treatment printhead 14 are controlled to eject drops of ink and fixer fluid at appropriate times such that a particular pattern is printed to reproduce image 30 on print medium 10.

The length of nozzle arrays 26 defines a print swath or band 53. The width of this band is commonly referred to as the "swath width", which defines the maximum pattern of ink or fixer fluid which can be laid down in a single transition of carriage 12. Print medium 10 is typically held stationary while the printheads complete a print swath. Typically, after carriage 12 traverses a print swath 53, print medium 10 is advanced along axis 52 and carriage 12 traverses again for printing another portion of print medium 10. Advance of print medium 10 may be performed after a back and forth transition of carriage 12 over print swath 53. Typically, print medium 10 is advanced a fraction of the swath width. Thereby, ink and/or fixer on a particular spot of print medium can be deposited from different nozzles of a printhead in successive transitions of carriage 12 over the particular spot.

Generally, an accurate positioning of ink or fixer drops on print media 10 is desired. However, during operation of a printing system, an accurate positioning of the drops may be compromised by a printhead misalignment relative to a print medium. Printhead misalignment may be caused, for example, by an incorrect positioning of a printhead due to manufacturing tolerances and/or incorrect printhead placement on carriage 12.

Some methods are available for estimating a misalignment of an ink printhead. For example, a misalignment of an ink printhead can be estimated using optical sensor 24 for detecting positions of printed marks as further detailed below.

Misalignment may also affect a treatment printhead. FIG. 1 illustrates a misalignment of treatment printhead 14 along the horizontal axis. The illustrated horizontal misalignment is caused by a displacement along axis 54 of treatment printhead 14 from a nominal position 51. The misalignment of treatment printhead 14 is illustrated by distance 32. Misalignment of treatment printhead 14 results in an incorrect placement of fixer fluid 40 on print medium 10. In the illustrated example, printing system 1 operates treatment printhead 14 for applying fixing fluid over a vertical line 49. However, due to misalignment, fixer fluid 40 is applied on print medium 10 along a line 49', which is laterally displaced relative to vertical line 49 (the theoretical positions where fixing fluid would be applied without misalignment, or with an accurate correction thereof).

It will be understood that misalignment of a treatment printhead may have other causes, such as an incorrect placement of treatment printhead 14 along the vertical axis. Further, incorrect positioning of other elements of printing system 1, such as carriage 12 or carriage rod 4, may also cause misalignment of treatment printhead 14. Further, incorrect positioning of print medium 10 may also cause misalignment. A combination of different causes may also originate misalignment of treatment printhead 14.

Figure 2:
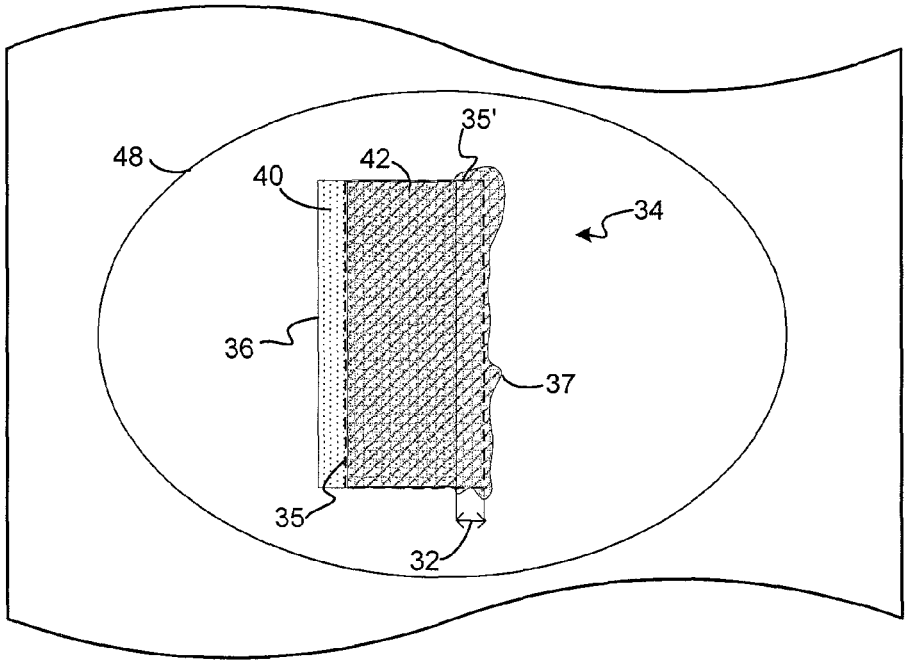
FIG. 2 is a simplified diagram of a mark printed by the printing system of FIG. 1.

As set forth above, misalignment of a printhead for applying fixer fluid may compromise print quality of a printed pattern, as illustrated by FIG. 2. FIG. 2 is a simplified diagram of a mark 34 printed by printing system 1. Mark 34 is printed by operating ink printheads of printing system 1 for depositing ink 42 over a print area 35. Ink 42 on print medium 10 is illustrated in the figure by a line pattern. Treatment printhead 14 is operated for applying a fixer fluid 40 over an area 36 of background region 48. Fixer fluid 40 deposited on print medium 10 is illustrated in the figure by the dotted pattern of area 36.

Generally, a complete overlapping of area 36 and print area 35 is preferable. Complete overlapping facilitates a better print quality of mark 34 by treating the whole ink applied to print area 35. In particular, it is thereby facilitated that ink 42 does not migrate from the deposition position. In the illustrated example, treatment area 36 is horizontally displaced from print area 35 a distance 32 due to misalignment of treatment printhead 14. Consequently, a portion 35' of print area 35 is not treated with fixer fluid 40. Therefore, ink in portion 35' remains untreated by fixer 40. Untreated ink is prone to migration outside of print area 35. In the illustrated example, print migration originates a jagged edge 37 on the right side of mark 34 thereby worsening print quality of mark 34.

Figure 5:
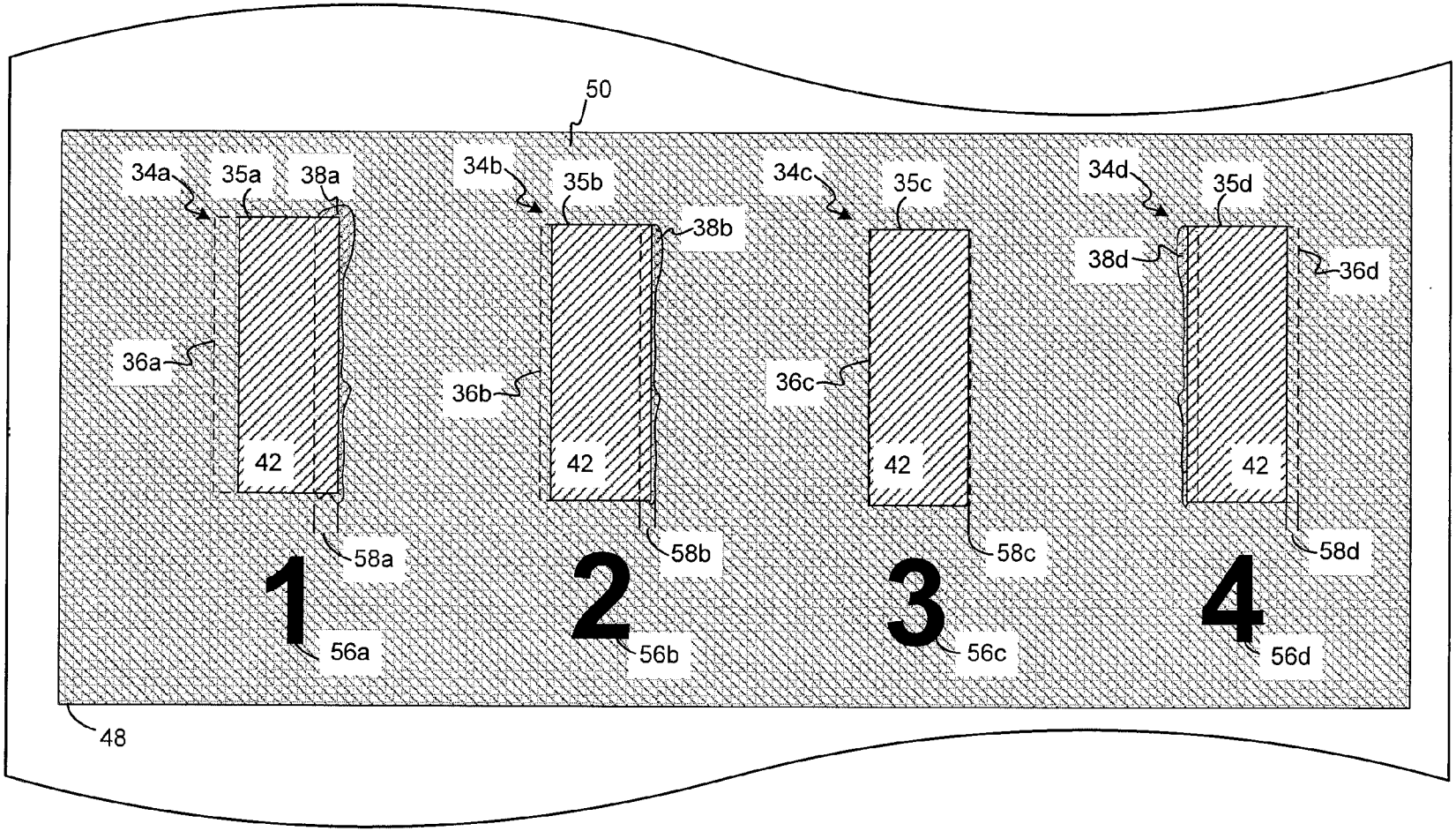
FIG. 5 is a simplified diagram of a printing pattern printed by a printing system according to embodiments herein.

If background region 48 would be printed with a background color, ink migration from the untreated portion 35' would likely cause color bleed (as illustrated in the example shown in FIG. 5.) Color bleed refers to unwanted mixing of ink applied onto a particular area with ink applied onto a surrounding area. Typically, color bleed is produced at the borders of the particular area contiguous to the surrounding area.

As the above example illustrates, a misalignment of a treatment printhead may compromise print quality of a printing system. Methods for estimating misalignment of a treatment printhead are desirable in order to facilitate at least one of: a) detecting that a treatment printhead is affected by misalignment; b) quantifying a misalignment of a treatment printhead; and/or c) correcting a misalignment of a treatment printhead for subsequent printing.

Methods performed by a printing system are described herein. The methods include estimation of a misalignment of a printhead used for applying a fixer fluid (such as treatment printhead 14.) The methods typically include providing a request to a user to enter data related to print quality of at least one mark printed on at least one portion of a background region. The background region includes at least one area treated with a fixer fluid applied by a printhead.

Printing system 1 may provide a request to a user to indicate print quality of mark 34 in the above example. The request may be more specific, e.g. asking the user to indicate whether and how mark 34 is affected by color bleed or jagged edges. The request may refer to a plurality of marks printed using different printing conditions related to positioning of a treatment printhead. Such a request may ask the user which one of the marks is printed with the highest print quality in order to estimate which printing conditions lead to an accurate positioning of the treatment printhead. Some examples of requests related to print quality are further illustrated below with reference to FIG. 4.

The methods described herein typically further include: receiving a user input associated to the request and estimating in accordance with the user input a misalignment of the printhead used for applying the fixer fluid. For example, printing system 1 may receive a user input indicating that print quality of mark 34 is deficient and, therefore, estimate that treatment printhead 14 is misaligned. In case the user input includes further indications, printing system 1 may estimate printhead misalignment in a more specific manner. For example, if the user indicates which portions of mark 34 are affected by jagged edges, printing system 1 may estimate a misalignment direction. Further, if a plurality of marks are printed using different printing conditions and the user input indicates which marks are printed with a sufficiently high quality, printing system 1 may estimate treatment printhead misalignment from the used print conditions. Examples of estimation of a treatment printhead are further detailed below.

Methods described herein typically facilitate that a user self optimizes printing quality by providing a feedback related to results achieved in the application of a fixer fluid to a printed mark. This approach may be particularly convenient since a fixer is typically intended to correct defects that are visualized by a user. That is, since a fixer fluid typically addresses print quality issues noticeable by a user, user input regarding print quality is a convenient information source for estimating whether and how a treatment printhead is misaligned.

In particular, it should be noted that methods described herein involving a user input for estimating misalignment of a treatment printhead may be, under at least some circumstances, more effective than fully automatic methods. Fully automatic methods refer to methods estimating misalignment of a treatment printhead without using a user input related to print quality of a treated print pattern. Fully automatic methods generally rely on indirect measurements that are not directly related to effects that a fixer fluid addresses. Compared thereto, methods herein generally use a user input that directly provides information about the effects that a fixer fluid addresses. Thereby, an estimation of misalignment according to examples herein may facilitate a more efficient correction of these effects as compared to fully automatic methods.

Furthermore, it should be noted that at least some fixer fluids are transparent to detection by sensors implemented in printing systems, such as optical sensor 24. As used herein, transparent to detection indicates that a printing system cannot directly detect a fixer fluid deposited on the print medium using a sensor (e.g., an optical sensor or any other sensor suitable for detecting material deposited on a print medium) with the accuracy required for performing automatic estimation of misalignment affecting a treatment printhead. In such circumstances, some methods for fully automatic estimation may be inaccurate or unfeasible.

Figure 3:
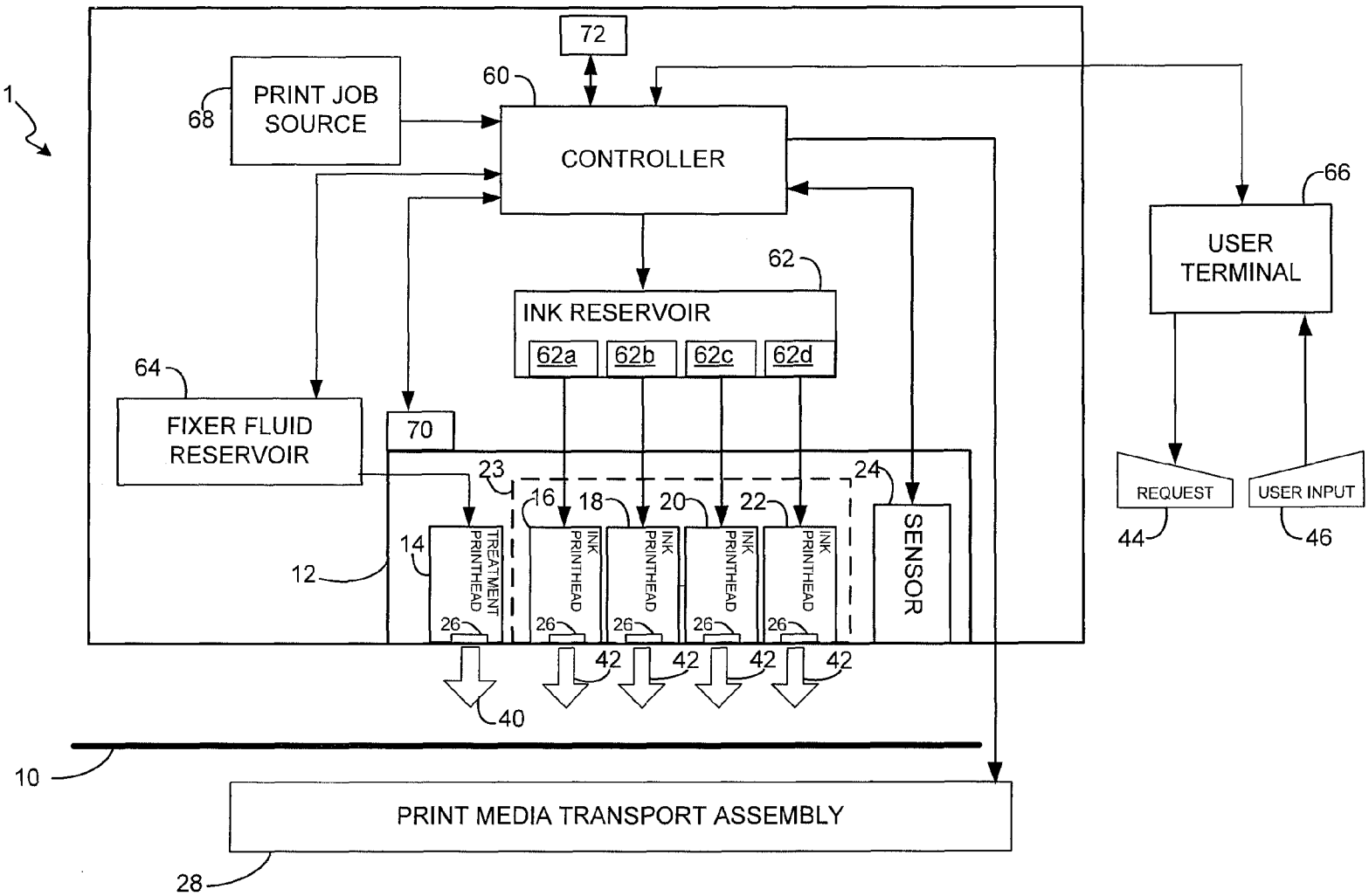
FIG. 3 is a block diagram of a printing system according to an embodiment herein.

FIG. 3 is a block diagram of printing system 1 according to an example. The block diagram shows that treatment printhead 14 is fluidly connected to a fixer fluid reservoir 64. Ink printheads 16, 18, 20, 22 constitute a printhead assembly 23 and are fluidly connected to an ink reservoir 62. Ink reservoir 62 includes separated reservoirs 62*a*, 62*b*, 62*c*, 62*d* for providing ink to the respective ink printhead. In the illustrated example, separated reservoirs 62*a*, 62*b*, 62*c*, 62*d* respectively store cyan ink, magenta ink, yellow ink, and black ink. Printing system 1 further includes a controller 60 operatively connected to: a print job source 68, a memory device 72, a user terminal 66, ink reservoir 62, fixer fluid reservoir 64, optical sensor 24, a carriage drive 70, and print media transport assembly 28.

Typically, ink reservoir 62 and fixer fluid reservoir 64 include disposable cartridges. Further, the reservoirs may be mounted on carriage 12 in a position adjacent to the respective printhead. In other configurations (also referred to as off-axis systems), a small fluid supply (ink or fixer) is provided to cartridges (not shown) in carriage 12, each cartridge being associated to a respective printhead; main supplies for ink and fixer are then stored in the respective reservoirs. In an off-axis system, flexible conduits are used to convey the fluid from the off-axis main supplies to the corresponding printhead cartridge. Printheads and reservoirs may be combined into single units, also referred to as "pens".

Controller 60 is configured to execute methods described herein. Controller 60 may be implemented, for example, by one or more discrete modules (or data processing components) that are not limited to any particular hardware, firmware, or software (i.e., machine readable instructions) configuration. Controller 60 may be implemented in any computing or data processing environment, including in digital electronic circuitry, e.g., an application-specific integrated circuit, such as a digital signal processor (DSP) or in computer hardware, firmware, device driver, or software (i.e., machine readable instructions). In some implementations, the functionalities of the modules are combined into a single data processing component. In other versions, the respective functionalities of each of one or more of the modules are performed by a respective set of multiple data processing components.

Memory device 72 is accessible by controller 60. Memory device 72 stores process instructions (e.g., machine-readable code, such as computer software) for implementing methods executed by controller 60, as well as data that controller 60 generates or processes. Memory device 72 referred to above may include one or more tangible machine-readable storage media. Memory devices suitable for embodying these instructions and data include all forms of computer-readable memory, including, for example, semiconductor memory devices, such as EPROM, EEPROM, and flash memory devices, magnetic disks such as internal hard disks and removable hard disks, magneto-optical disks, or ROM/RAM devices.

Controller 60 is operatively connected to treatment printhead 14 and ink printhead assembly 23 and the respective reservoirs to control operation thereof, in particular ejection of ink 42 and fixer 40 for printing a pattern on print medium 10. Controller 60 receives print job commands and data from print job source 68, which may be a computer source or other source of print jobs. Controller 60 acts on the received commands to provide motion control signals to: i) print media transport assembly 28 to advance print medium 10 along axis 52; and ii) carriage drive 70 to traverse carriage 12 across print medium 10. Controller 60 may generate the motion control signals in consideration of estimation printhead misalignments, for example by using calibration data stored in memory device 72. Further, controller 60 provides firing signals to nozzle arrays 26 in the respective printheads in order to eject ink and/or fixer at particular locations on print medium 10 during transition of carriage 12 over print medium 1.

As shown in the present example, controller 60 may be operatively connected to optical sensor 24 to automatically estimate a misalignment of an ink printhead. Further, controller 60 is operatively connected to user terminal 66 in order to estimate a misalignment of treatment printhead 14 in accordance with user inputs as described herein. User terminal 66 is configured to: a) provide a request 44 for a user input 46; and b) receive a user input 46.

Figure 4:
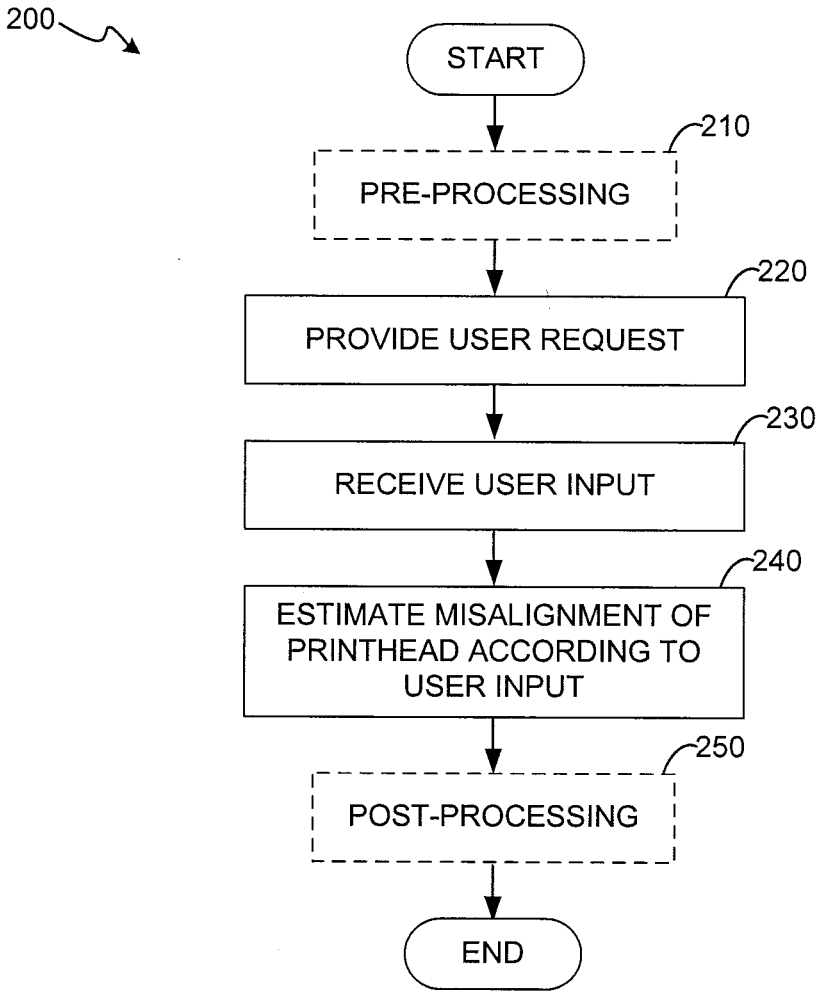
FIG. 4 is a process flow diagram of a method performed by a printing system according to an embodiment herein.

FIG. 4 is a process flow diagram illustrating a method performed by printing system 1 according to an example. The depicted process flow 200 may be carried out by execution of sequences of executable instructions. The executable instructions may be stored in a tangible machine readable storage medium such as, but not limited to, memory device 72. Process flow 200 may be carried out by controller 60 or any other suitable element of a printing system.

Process flow 200 is executed for estimating misalignment of a printhead configured to eject a fixer fluid (also referred herein to as a treatment printhead.) The method is typically performed for facilitating an adequate print quality. Process flow 200 may be performed at predetermined servicing intervals as part of routine maintenance of a printing system. Additionally or alternatively thereto, process flow 200 may be performed after events that may compromise alignment of a treatment printhead. For example, process flow 200 may be performed when a new treatment printhead is mounted on carriage 12 or after servicing of elements coupled to carriage 12 such as carriage rod 4. Additionally or alternatively thereto, a user may prompt a printer system to execute process flow 200, in particular when a user thinks that a treatment printhead is misaligned (e.g., after noticing poor print quality.) User terminal 66 may be configured to receive a user prompt to execute process flow 200 and send a suitable signal to controller 60 for executing the process.

In the following, process flow 200 is described with reference to elements depicted in FIG. 5. FIG. 5 is a simplified diagram of a printing pattern printed by a printing system according to an example.

Process flow 200 typically includes a pre-processing step 210. Pre-processing step 210 may include printing a background color 50 on a background region 48. In particular, controller 60 may control ink printhead assembly 23 so as to print background color 50 (illustrated by a lined pattern) on background region 48. Pre-processing step 210 may further include printing a mark on a background region. In particular, controller 60 may control the ink printhead assembly 23 to eject ink 42 over print areas 35*a*, 35*b*, 35*c*, 35*d*. Thereby, a plurality of test marks 34*a*, 34*b*, 34*c*, 34*d* are printed on background region 48, as illustrated in FIG. 5.

A printed test mark may have any suitable shape, dimensions, and color that facilitate user identification of print quality of the test mark. Typically, as shown in FIG. 5, a test mark is a thick line solidly printed with a uniform color (illustrated by a lined pattern). For example, the test mark may have a width between 1 mm and 1 cm such as 2 mm; the test mark width may have a length between 1 cm and 30 cm such as 15 cm.

Typically, the background color and the test mark or marks are chosen such that the effect that the fixer prevents is noticeable by a user. In particular, the background color and the test mark may be chosen such that the effect that the fixer prevents is maximized. Thereby, user identification of the effect prevented by the fixer (e.g., color bleeding) is facilitated. For example, the background color may be yellow and the test marks may be black marks, so that non-treated edges of the test marks are particularly affected by a noticeable color bleed.

Pre-processing step 210 may further include printing a plurality of labels 56*a*, 56*b*, 56*c*, 56*d*. Each of labels 56*a*, 56*b*, 56*c*, 56*d* is associated to a respective test mark 34*a*, 34*b*, 34*c*, 34*d*. In particular, controller 60 may control ink printhead assembly 23 so as to print labels 56*a*, 56*b*, 56*c*, 56*d*. Printing labels associated to test marks facilitate that a user can adequately specify print quality of the printed marks at user terminal 66.

Pre-processing step 210 may further include treating at least one area of the background region with a fixer fluid applied by a treatment printhead. For example, controller 60 may control treatment printhead 14 so as to apply fixer fluid over at least one area in the background region. Typically, an area for treatment with fixer fluid is associated to a corresponding mark. In the example illustrated in FIG. 2, area 36 (where fixer 40 is applied) is associated to print area 35 (where ink 42 is deposited.) In particular, printing system 1 associates area 36 with mark 34 for treating ink of mark 34 with fixer fluid. It will be understood that if misalignment of treatment printhead 14 is particularly severe, a treated area may not overlap at all an associated mark. Referring back to the example illustrated in FIG. 5, fixer fluid is applied over a plurality of areas 36*a*, 36*b*, 36*c*, 36*d*. Each of these areas is associated to a respective test mark 34*a*, 34*b*, 34*c*, 34*d*.

Controller 60 may associate an area for treatment to a particular mark by calculating an area over which fixer fluid is ejected. Typically, the calculated area corresponds to the area of the associated mark. Typically, controller 60 takes into account positioning data of treatment printhead 14 for calculating the area over which fixer fluid is ejected. Typically, the positioning data takes into account a theoretical alignment of treatment printhead 14. If the theoretical alignment is accurate, controller 60 can calculate positions of treatment areas that coincide, in fact, with associated marks. The theoretical alignment may be corrected taking into account the result of previous estimations of misalignment of treatment printhead 14.

When a plurality of marks are printed, controller 60 may vary the conditions under which fixer is applied to the respective treatment areas for facilitating misalignment estimation. In particular, controller 60 may be configured such that each of the treatment areas is at a predetermined distance relative to an associated mark. Typically, the predetermined distances are distances between corresponding edges of a treatment area and a print area of an associated mark.

In the example illustrated in FIG. 5, each of areas 36*a*, 36*b*, 36*c*, 36*d* is at a different predetermined distance from the associated mark: area 36*a* is displaced a distance 58*a* from print area 35*a* of test mark 34*a* in the left direction; area 36*b* is displaced a distance 58*b* from print area 35*b* of test mark 34*b* in the left direction; area 36*c* is displaced a marginal distance 58*c* from a print area 35*c* of test mark 34*c*; and, area 36*d* is displaced a distance 58*d* from print area 35*d* of test mark 34*d* in the right direction.

It will be understood that the predetermined distances are theoretical values calculated by controller 60. If the positioning data available to controller 60 is not accurate (e.g., because a misalignment of treatment printhead 14 is not corrected by controller 60), the predetermined distances will not coincide with the distances between treated areas and associated printed marks in print medium 10. Typically, controller 60 cannot determine a priori which conditions (e.g., calibration of printhead alignment) for ejecting fixer fluid will lead to a treatment area which coincides with the associated mark. However, as further detailed above, a user input relating print quality of the marks may facilitate determining such conditions and accordingly correcting alignment of a treatment printhead.

The predetermined distances may be chosen to be different from each other. For example, predetermined distances corresponding to adjacent treatment areas may be successively incremented a fixed distance A. Fixed distance A may be, for example, a distance between 0.2 and 1 mm, such as 0.4 mm. Fixed distance A may correspond to the endpoint accuracy of printing system 1. Endpoint accuracy specifies how accurately a printer system can draw a specific length of line. Printing system 1 may calculate the treatment areas shown in FIG. 5 such that: treatment area 36*a* corresponds to an area with a displacement 2×A to the left from a print area 35*a*; treatment area 36*b* corresponds to an area with a displacement A to the left from an print area 35*b* on which ink is applied; treatment area 36*c* corresponds to an area with a displacement A to the right from a print area 35*c* on which ink is applied; and treatment area 36*d* corresponds to an area with a displacement 2×A to the right from a print area 35*d* on which ink is applied.

Pre-processing step 210 may further include correcting misalignment of an ink printhead used for printing a mark. Thereby, an accurate estimation of misalignment of the treatment printhead is facilitated. In particular, a mark printed with a misaligned ink printhead may render estimation of misalignment of a treatment printhead inaccurate.

Correction of misalignment of an ink printhead can be performed according to any suitable method for correcting misalignment of an ink printhead. For example, controller 60 may operate optical sensor 24 for estimating a misalignment of a printhead in ink printhead assembly 23. Furthermore, controller 60 may correct alignment data of any of the ink printheads stored in memory device 72. Controller 60 may then execute printing of test marks 34*a*, 34*b*, 34*c*, 34*d* using the corrected alignment data. For example, printing system 1 may perform an automatic estimation of misalignment of an ink printhead by: operating an ink printhead for printing a line of marks along a particular direction (e.g., the vertical axis); then, stepwise advancing print medium 10, thereby detecting the positions of successive printed marks using optical sensor 24; and, finally, comparing the detected position of the printed marks with the theoretical positions where the marks should be printed according to printhead alignment data available to printing system 1. If the estimation results in the determination of a misalignment of an ink printhead, the misalignment may be corrected in subsequent prints using a suitable calibration method, such as those described in U.S. Pat. No. 7,543,905.

Pre-processing step 210 results in the pattern illustrated in FIG. 5. Background region 48 is printed with background color 50. Test marks 34*a*, 34*b*, 34*c*, 34*d* are printed as a result of ejecting ink 42 over print areas 35*a*, 35*b*, 35*c*, 35*d*. Furthermore, areas 36*a*, 36*b*, 36*c*, 36*d* are treated with a fixer fluid ejected from treatment printhead 14. In this example, the fixer fluid is for preventing color bleed. Treated areas 36*a*, 36*b*, 36*d* do not completely overlap the respectively associated print areas 35*a*, 35*b*, 35*d* and, consequently, the corresponding marks 34*a*, 34*b*, 34*c* are affected by color bleed. In particular, the right edges 38*a*, 38*b* of marks 34*a*, 34*b* and the left edge 38*d* of mark 34*d* are affected by color bleed (highlighted by a cross-hatched pattern.) Treated area 36*c* completely overlaps print area 35*c*, so that no color bleed is perceptible for mark 34*c*.

It will be understood that embodiments herein can be performed without requiring execution of a pre-processing step 210 as described above. For example, process flow 200 may be executed using a pre-printed medium. The pre-printed medium typically includes a mark printed on at least one portion of a background region. The background region is typically printed with a background color. The background region includes at least one area treated with a fixer fluid applied by a printhead. Such a pre-printed medium may be loaded into printing system 1 and process flow 200 may be performed omitting pre-processing step 210.

Process flow 200 includes a step 220, in which printing system 1 provides request 44 to a user. Request 44 is related to print quality of a mark. In step 230, printing system 1 receives user input 46 associated to request 44. In particular, controller 60 may operate user terminal 66 to prompt the user for a user input 46. The user can enter user input 46 into user terminal 66. User terminal 66 may then provide data related to the received user input 46 to controller 60.

In a further step 240, misalignment of treatment printhead 14 is estimated according to user input 46. For example, controller 60 may process the data provided by user terminal 66 regarding user input 46. Then, controller 60 may use the data for estimating misalignment of treatment printhead 14.

Request 44 may be relatively unspecific. For example, referring back to the example of FIG. 2, user terminal 66 may prompt the user to indicate whether mark 34 is printed with sufficient quality. In view of jagged edge 37, the user may then provide a user input specifying that mark 34 is not printed with sufficient quality. In accordance with this user input, controller 60 may estimate that treatment printhead 14 is misaligned. The latter estimation may be particularly accurate, when printing system 1 correctly takes into account alignment of elements involved in printing of mark 34 as set forth above.

Another example for request 44 is illustrated referring back to FIG. 5. Request 44 may prompt a user to choose a mark from a plurality of printed marks by comparing print quality of the different marks. In particular, user terminal 66 may prompt the user to specify which of test marks 34*a*, 34*b*, 34*c*, 34*d* is printed with the highest quality. The user input may then indicate one of labels 56*a*, 56*b*, 56*c*, 56*d* (i.e., "1", "2", "3", or "4".) In the illustrated example, a user may specify mark 34*c* as being the mark printed with the highest quality by entering label 56*c* (i.e., "3") into user terminal 66.

Request 44 may be more specific than the above illustrated examples. For example, request 44 may relate to color bleed affecting a printed mark. In that case, user terminal 66 may prompt the user to indicate whether a printed mark is affected by color bleed. If multiple marks are printed, the user input may specify one of the marks as being the mark less affected by color bleed. If the fixer fluid is predetermined for preventing color bleed between a mark and a background color printed on the background area, a request related to color bleed may be particularly efficient. Request 44 may also relate to other effects that a fixer fluid prevents, such as coalescence, or other effects related to ink migration.

Request 44 may ask the user to indicate how print quality of a printed mark is affected. For example, referring back to the example illustrate in FIG. 2, user terminal 66 may prompt the user to indicate which edges of printed mark 34 are jagged. In this particular example, the user may indicate that the right edge of mark 34 is jagged. This spatial information may be used by controller 60 to estimate how treatment printhead 14 is misaligned. For example, from this user input, controller 60 may infer that treatment head 14 is misaligned in the left direction. Furthermore, controller 60 may correct alignment data of treatment head 14 according to the estimated misalignment. Successive equivalent tests and corrections may be performed until mark 34 is printed with a print quality satisfactory to the user.

It will be understood that request 44 may combine different inquiries to the user. For example, request 44 may prompt the user to indicate which test marks are less affected by color bleed, whether the indicated mark is affected by appreciable color bleed, a degree of color bleed, and/or edges of a mark affected by color bleed.

Figure 6:
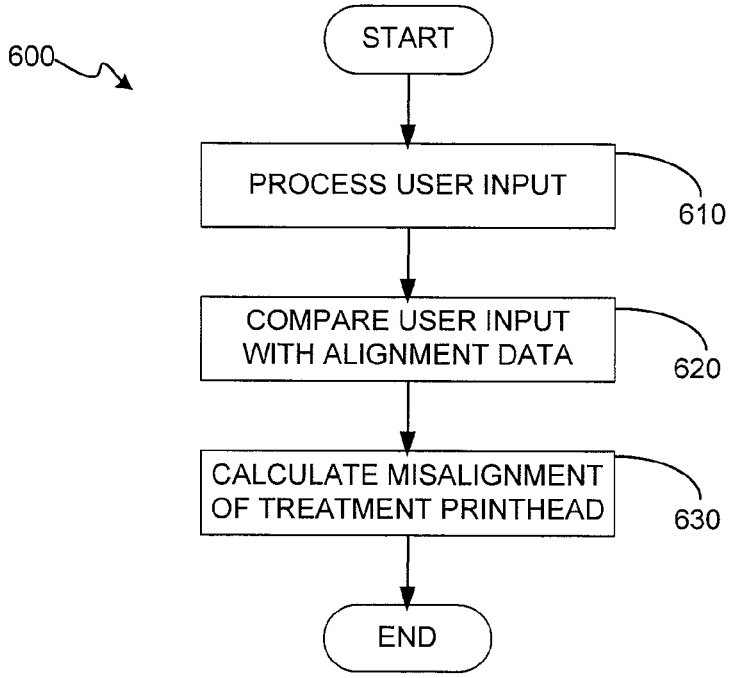
FIG. 6 is another process flow diagram illustrating a method performed by a printing system according to an embodiment herein.

Process flow 200 typically may include a post-processing step 250. Post-processing step 250 typically includes quantifying a misalignment of a treatment printhead. FIG. 6 is a process flow diagram illustrating a method 600 of quantifying a misalignment of a treatment printhead. At step 610, user input 46 is processed by controller 60. At step 620, user input 46 is compared with alignment data of treatment printhead 14. At step 630 misalignment of treatment printhead 14 is calculated based on the comparison in step 620. For example, referring back to the illustration of FIG. 5, controller 60 may determine that the printing conditions of test mark 34*c* correspond to printing conditions that compensate misalignment of treatment printhead 14. Controller 60 may then compare these printing conditions with stored alignment data of treatment printhead 14 and determine that treatment printhead 14 is misaligned a distance 32 to the left, as shown in FIG. 1.

Figure 7:
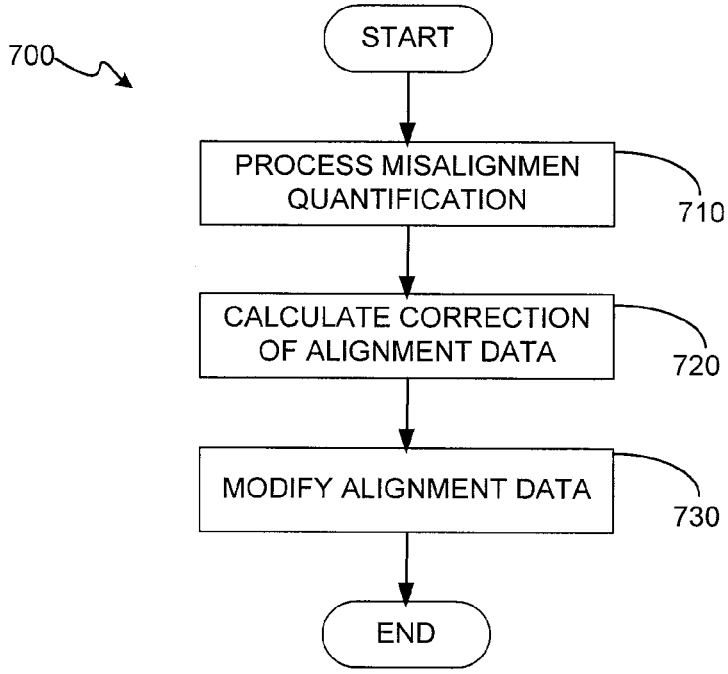
FIG. 7 is yet another process flow diagram illustrating a method performed by a printing system according to an embodiment herein.

Post-processing step 250 typically includes compensating a misalignment of printhead 14 based on the result of an estimation of misalignment of a treatment printhead in step 240. FIG. 7 is a process flow diagram illustrating a method 700 of compensating a misalignment of treatment printhead 14 performed by printing system 1 according to an example.

At step 710, the result of a quantification of misalignment of a treatment printhead (obtained, e.g., using method 600) is processed by controller 60. In a further step 720, controller 60 may calculate a correction in alignment data of treatment printhead 14 stored in memory device 72. In a further step 730, controller 60 may accordingly modify alignment data of treatment printhead 14 stored in memory device 72.

Printing system 1 may perform subsequent print using a compensation of printhead misalignment. In particular, controller 60 may execute subsequent printing using the modify alignment data of treatment printhead 14 according to method 700. For example, controller 60 may execute process flow 200 for estimating a misalignment of treatment printhead 14. Thereby, controller 60 may calculate an alignment correction algorithm for compensating a determined misalignment of treatment printhead. The alignment correction algorithm may be stored in memory device 72 so that a correction of printhead misalignment can be performed during subsequent printing for accurately placing a fixer on print medium 10. Subsequently, after a predetermined servicing time or an event such as printhead replacement, controller 60 may repeat process flow 200 for estimating a further misalignment of treatment printhead 14. The alignment correction algorithm may then be re-calculated and re-stored in memory device 72 upon determining a further misalignment of treatment printhead.

It will be understood that embodiments can be realized using different inks and fixer fluids. For example, the fixer fluid may consist of a cationic polymer for reducing colorant mobility or "fix" ink on a print medium. The ink and fixer compositions may comprise standard dye-based or pigment based inkjet ink and fixer solutions. As a non-limiting example, the fixer may include a water-based solution including acids, salts and organic counter ions and polyelectrolytes. The fixer may include other components such as biocides that inhibit growth of microorganisms, chelating agents (e.g., EDTA) that eliminate deleterious effects of heavy metal impurities, buffers, ultraviolet absorbers, corrosion inhibitors, and viscosity modifiers, which may be added to improve various properties of the ink and fixer compositions. In another example, the fixer may include a component that reacts with the ink. The component may have a charge opposite to the charge of the ink. For instance, if the ink is anionic, the fixer may include a cationic component. In addition, the fixer may be substantially devoid of a colorant or may include a colorant that does not absorb visible light.

The fixer fluid may also include a precipitating agent, such as a salt or an acid. The salt may include cations, such as calcium, magnesium, aluminum, or combinations thereof. The salt may include, but is not limited to, calcium nitrate, magnesium nitrate, or ammonium nitrate. The acid may be any mineral acid or an organic acid, such as succinic acid or glutaric acid. The precipitating agent may be used to change the conductivity or the pH of the ink, causing the pigment in the ink to precipitate on the surface of the print medium. The fixer may be over-printed and/or under-printed on the print medium relative to the ink Examples may be realized using water based latex-ink and fixer fluid suitable for fixing the latex-ink on the print medium. Thereby, quality of printing with latex-ink may be particularly improved, since latex-ink solutions may be more prone to color bleeding due to fluids in the ink solution. Other examples include solvent inks, water based inks, dye inks, or UV inks as well as fixer fluids appropriated thereto.

The print medium upon which the inkjet ink and/or fixer may be deposited may be any desired print medium. In some examples, the print media may be a plain print medium or a commercially coated brochure print medium. Plain print media may include, but are not limited to, Hammermill® Fore DP paper, produced by International Paper Co. (Stamford, Conn.), HP Multi-Purpose paper, produced by Hewlett-Packard Inc. (Palo Alto, Calif.), uncoated polyester fabrics, polyester films, or vinyl banners. Commercially coated brochure print media, such as the type used to print brochures or business flyers, are typically hydrophobic and non-porous or less porous than plain paper, including "Lustro Laser", produced by SD Warren Company (Muskegon, Mich.) Other examples include, among others, self-adhesive vinyls, any PVC banners, Polyproline media, polyethylene media, PET media, or polyester fabrics. The print medium may include a raw material. The print medium may be pre-treated or coated materials.

The examples described above provide methods and systems for estimation of misalignment of a printhead used for applying a fixer fluid. As discussed above, the examples may be successfully deployed in case that the fixer fluid is transparent to detection by an optical sensor implemented in a particular printing system. However, the examples may also be used in any environment in which a printing system implements a treatment printhead for applying a fixer fluid to a print medium.

It will be appreciated that embodiments can be realized in the form of hardware, software module or a combination of hardware and the software module. Any such software module, which includes machine-readable instructions, may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of a non-transitory computer-readable storage medium that are suitable for storing a program or programs that, when executed, for example by a processor, implement embodiments. Accordingly, it is contemplated a program comprising code for implementing a system or method as claimed in any of the accompanying claims and a non-transitory computer readable storage medium storing such a program.

In the foregoing description, numerous details are set forth to provide an understanding of the examples disclosed herein. However, it will be understood by those skilled in the art that the examples may be practiced without these details. While a limited number of examples have been disclosed, those skilled in the art will appreciate numerous modifications and variations therefrom. It is intended that the appended claims cover such modifications and variations as fall within the true spirit and scope of the disclosed examples.

What is claimed is:

1. A method performed by a printing system, the method comprising:

controlling an ink printhead to print a background color on a background region;

controlling the ink printhead to print a plurality of marks on the background region;

controlling a treatment printhead to apply fixer fluid over a plurality of areas in the background region, each of the areas being associated to a corresponding mark;

providing a request to a user to enter data related to print quality of at least one mark printed on at least one portion of the background region;

receiving a user input associated to the request; and estimating a misalignment of the treatment printhead in accordance with the user input.

2. The method of claim 1, wherein the fixer fluid is predetermined for preventing color bleed between the at least one mark and a background color printed on the background region.

3. The method of claim 2, wherein the user input relates to color bleed affecting the at least one mark.

4. The method of claim 1, wherein a plurality of marks are printed on different portions of the background region.

5. The method of claim 4, wherein the user input specifies one of the marks as being the mark less affected by color bleed.

6. The method of claim 4, wherein:

a plurality of labels are printed, each label being associated to a respective mark; and the user input specifies at least one of the labels.

7. The method of claim 1, wherein each of the treatment areas is at a predetermined distance relative to the associated mark, the predetermined distances being different from each other.

8. The method of claim 1, wherein correction of misalignment of a further printhead used for printing the at least one mark is performed before the fixer fluid is applied by the treatment printhead.

9. The method of claim 1 further comprising compensating a misalignment of the treatment printhead based on the result of the estimation of printhead misalignment.

10. The method of claim 1, further comprising printing an image on a print medium using the compensation of printhead misalignment.

11. The method of claim 1, wherein the fixer fluid is transparent to detection by an optical sensor of the printing system.

12. A printing system, comprising:

a treatment printhead configured to eject a fixer fluid;

an ink printhead assembly including a plurality of ink printheads configured to eject ink; and a controller operatively connectable to the treatment printhead and the ink printhead assembly to:

control the ink printhead assembly so as to print a background color on a background region;

control the ink printhead assembly so as to print a plurality of test marks on the background region;

control the treatment printhead so as to apply fixer fluid over a plurality of areas in the background region, each of the areas being associated to a corresponding test mark;

generate a request for a user related to print quality of the test marks;

receive the user input associated with the request; and estimate a misalignment of the treatment printhead in accordance with the user input.

13. The printing system of claim 12, wherein the user request for the user is to indicate which of the test marks is less affected by color bleed.

14. The printing system of claim 13, wherein:

the controller is further configured to control the ink printhead assembly so as to print a plurality of labels, each label being associated to a respective test mark; and the user input specifies at least one of the labels.

15. The printing system of claim 14, wherein the controller is further configured such that each of the treatment areas is at a predetermined distance relative to the associated test mark, the predetermined distances being different from each other.

16. The printing system of claim 12, wherein the controller is further configured to correct misalignment of the plurality of ink printheads before controlling the treatment printhead to treat the plurality of areas.

17. The printing system of claim 12, wherein the controller is further configured to compensate a misalignment of the printhead during subsequent printing based on the result of the estimation of printhead misalignment.

18. The printing system of claim 12, wherein the system further includes a sensor to which the fixer fluid is transparent.

19. A non-transitory machine readable storage medium storing instructions that when executed implement a method performed by a printing system, comprising: controlling an ink printhead to print a background color on a background region; controlling the ink printhead to print a plurality of marks on the background region; controlling a treatment printhead to apply fixer fluid over a plurality of areas in the background region, each of the areas being associated to a corresponding mark;

providing a request to a user to enter data related to print quality of at least one mark printed on at least one portion of the background region; receiving a user input associated to the request; and estimating a misalignment of the treatment printhead in accordance with the user input.

* * * * *